United States Patent [19]

Li

[11] 4,210,191

[45] Jul. 1, 1980

[54] FILM-TYPE STORM WINDOW

[76] Inventor: Yao T. Li, Huckleberry Hill, Lincoln, Mass. 01773

[21] Appl. No.: 920,782

[22] Filed: Jun. 30, 1978

[51] Int. Cl.[2] ..... A47H 23/00

[52] U.S. Cl. ..... 160/354; 160/328; 160/378

[58] Field of Search ..... 160/327, 328, 354, 368 R, 160/378, 374.1; 135/1 R

[56] References Cited

U.S. PATENT DOCUMENTS

| | | | |
|---|---|---|---|
| 2,891,603 | 6/1959 | Lilienfeld | 160/378 |
| 3,374,797 | 3/1968 | Neumark | 135/1 R |
| 3,496,686 | 2/1970 | Bird | 135/1 R |
| 3,991,806 | 11/1976 | Abell | 160/354 |
| 4,046,186 | 9/1977 | Nordstrom | 160/368 R |

*Primary Examiner*—Peter M. Caun

*Attorney, Agent, or Firm*—Kenway & Jenney

[57] ABSTRACT

A protective, flexible membrane structure for installation in a framed opening with corners. Typically a clear plastic structure having a peripheral tension element running through affixed tubes lying in peripheral circular arcs. Tensioning members at the corners apply tension to the tension element to produce a flat, wrinkle-free surface. In preferred embodiments the tension means also have clamping means to hold folded corners of the flexible membrane, a fold of the membrane along the perimeter of the membrane lying against the frame of the opening to provide a sealing arrangement.

5 Claims, 7 Drawing Figures

FIG. 4
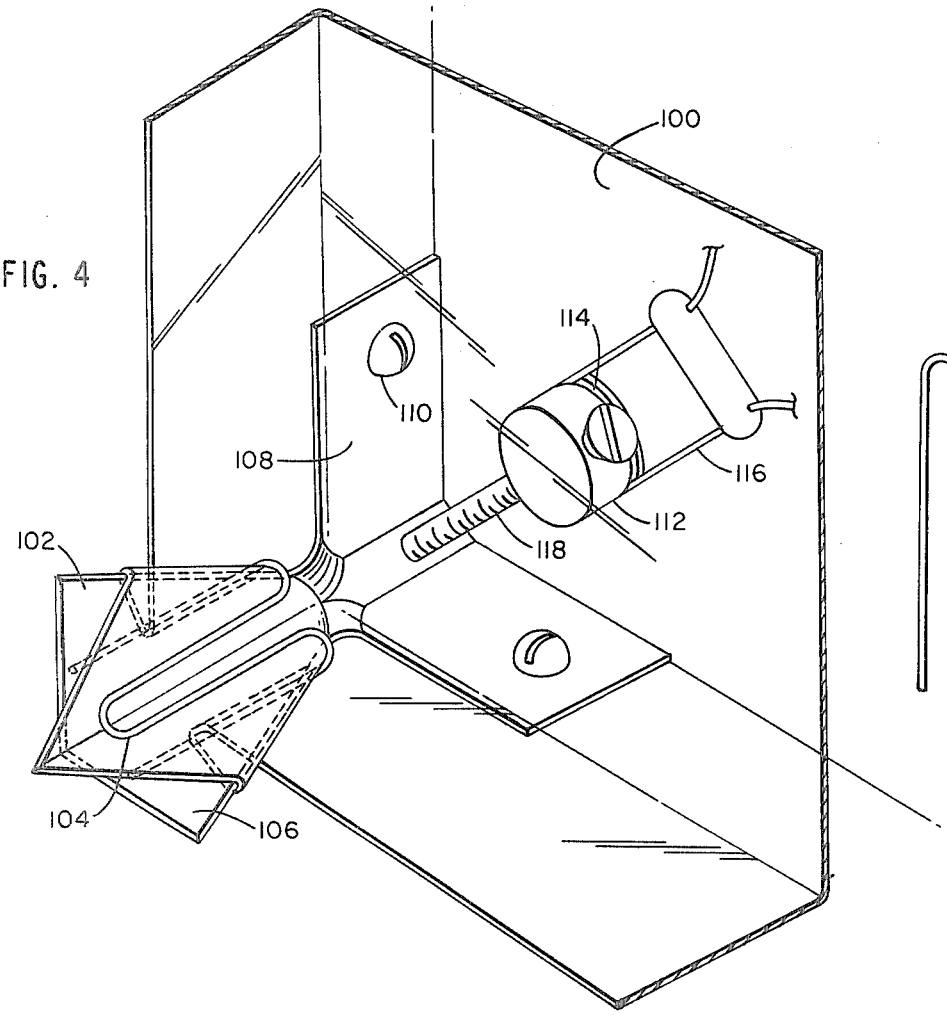
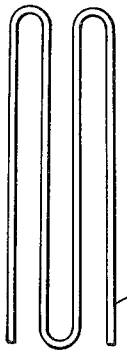
FIG. 5
FIG. 6
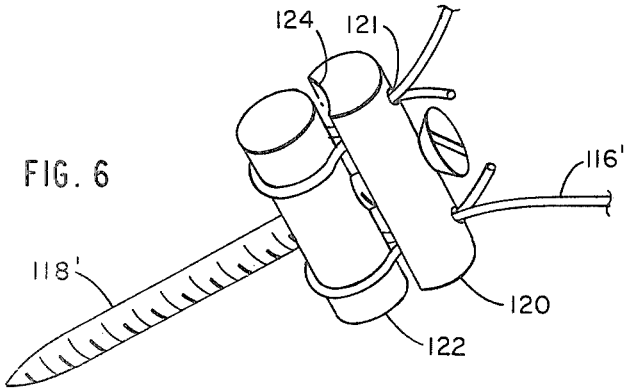
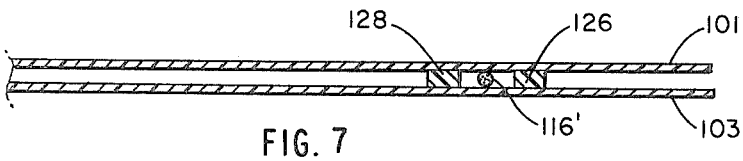
FIG. 7

FILM-TYPE STORM WINDOW

BACKGROUND OF THE INVENTION

This invention relates to protective membrane structures and especially to transparent film structures to provide temporary storm window protection.

There are very many temporary or presumably inexpensive structures to provide protection or sealing covers for windows or other openings. For example, there is the very early De Coursey U.S. Pat. No. 55,473 directed to a window mosquito net and the more recent Hoodis U.S. Pat. No. 2,237,778 directed to a drying cover to be affixed over a bathtub. While these two structures happen to be perforate structures to admit air or exclude mosquitos or to provide a drying surface, they are the closest tensioning arrangements which applicant has found in the prior art. Unfortunately it is almost impossible to achieve a really plane surface providing distortion-free viewing with such tensioning arrangements.

Accordingly it is an object of the present invention to provide a protective, flexible membrane structure having a tensioned plane surface which minimizes distortion produced by wrinkles or other surface irregularities.

Another object is to provide a temporary protective window which may be easily installed and removed.

A further object is to provide a protective, film-type storm window with effective sealing around the perimeter.

SUMMARY OF THE INVENTION

A protective, flexible membrane structure according to the present invention includes a membrane, typically a film of clear plastic, having hollow tubes affixed near its perimeter portions. These tubes are affixed along segments of circular arcs. A tensioning element, a cord or wire-like element, passes through the tubular elements and engages tensioning members at each corner of the framed opening. When tension is applied to the tensioning member, the plastic is pulled tight along the circular section resulting in uniform tension applied to the plastic film lying within the circular elements to produce a uniformly tensioned, wrinkle-free plane surface. In preferred embodiments the corners are also provided with means to hold folded portions of the membrane or film to provide a neat fold of film overlapping the frame around the entire perimeter of the framed opening. This overlap provides an effective seal.

BRIEF DESCRIPTION OF THE DRAWINGS

The invention and its various features may be more fully understood from the following description in conjunction with the accompanying drawings in which

FIG. 4 is a perspective view of another embodiment of a corner of the frame opening;

FIG. 5 is a plane view of an M spring for the corner of FIG. 4;

FIG. 6 is a perspective view of a clamping arrangment for the ends of the tensioning means; and FIG. 7 is a cross section view showing a panel for the tensioning member in a double thickness film window.

DESCRIPTION OF THE PREFERRED EMBODIMENT

Figure 1:
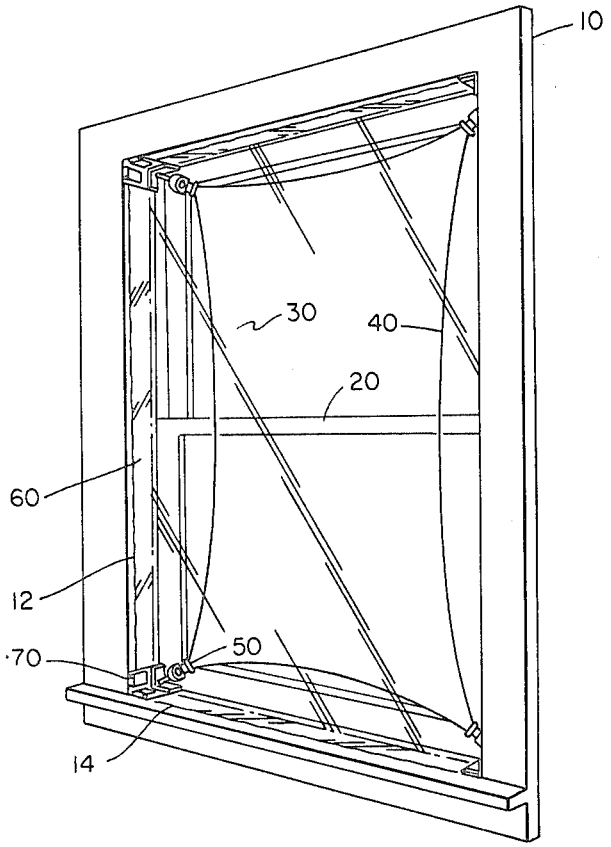
FIG. 1 is a view in perspective of an embodiment of the present invention serving as a storm window for a conventional framed, double-hung window.

Referring now to FIG. 1, a window frame 10 is shown for a double-hung window 20. Adjacent to the double-hung window 20 a transparent plastic film 30 provides a removable storm window. The film 30 is held taut and wrinkle-free by a tension member 40 lying in the peripheral portions of the film 30. Tension is applied to the member 40 by tension fastening means 50 at each of the four corners. Applicant has found that uniform tension and a wrinkle-free surface can be provided if the tension member 40 lies along arcs of a circle. With this configuration the wrinkles and sagging portions inherent in prior devices having cords which snug the film or screen alongside the frame are avoided. While it might be thought that parabolic curves should be employed, applicant has found that arcs of a circle are preferable for even tension and wrinkle-free surface. lA perimeter portion 60 of transparent film lies in a fold adjacent the frame 10. At each corner holding means 70, shown associated with tensioning means 50, hold the corner folds of the film 30 flat against the inner portions 12 and 14 of the frame 10 as shown.

Figure 2:
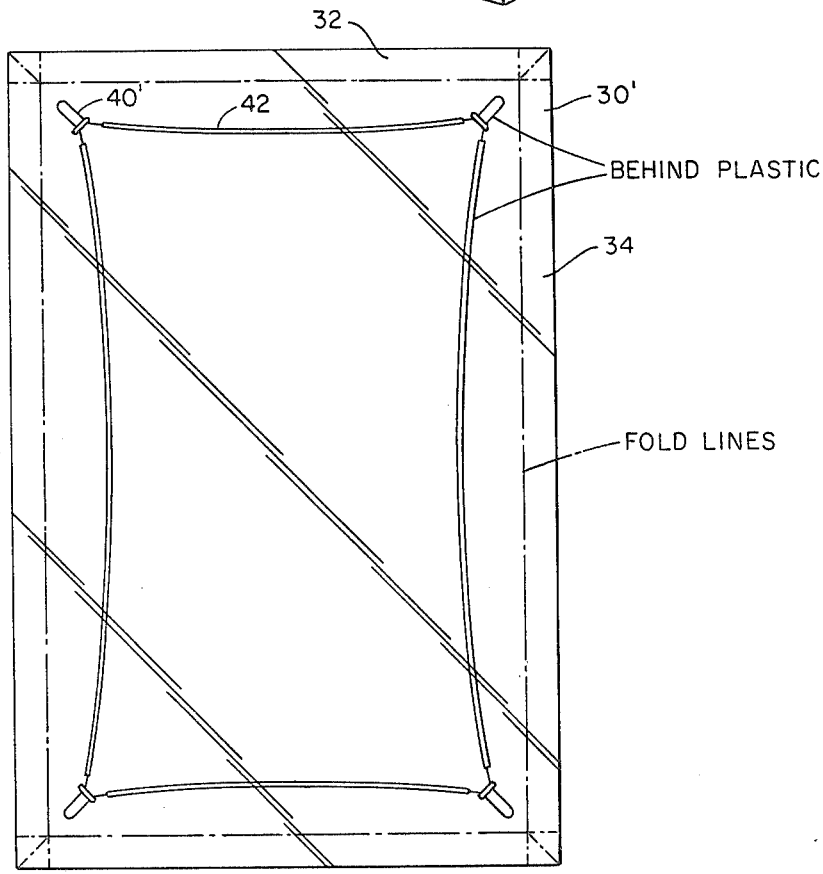
FIG. 2 is a plane of the plastic film or membrane utilized in the structure of FIG. 1.

Referring now to FIG. 2, the film or membrane 30′ corresponding to the film 30 of FIG. 1 is shown before installation in a framed opening. Broken lines indicate portions 32 and 34 which will fold against the inside of the frame 10. The tensioning member 40′ is shown passing through tubular sections 42. These tubular sections 42 are affixed to the films 30′ along segments of circular arcs. Thus when the film 30′ is installed in frame 10 as shown in FIG. 1 and the tensioning means 50 apply tension to the tension member 40′, the transparent film or membrane is snugged taut by the force along the circular arcs defined by the tubes 42.

Figure 3:
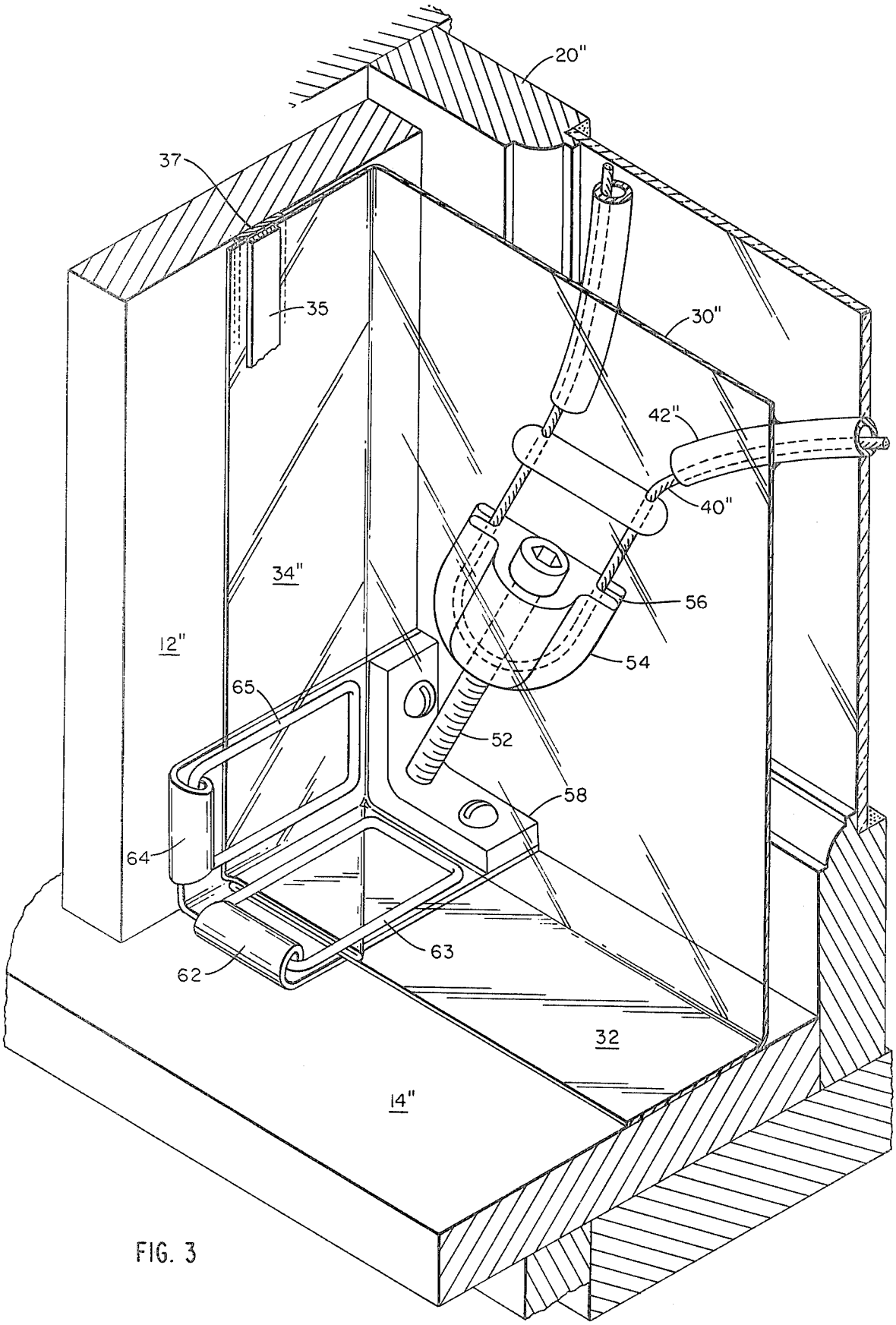
FIG. 3 is a perspective view showing details of a corner of the framed opening including the tensioning means and means to hold the overlap of the plastic film in place.

Referring now to FIG. 3, a corner of the framed opening shown in FIG. 1 is set forth in perspective. The film 30″ is shown adjacent the double-hung window 20″. The tensioning member 40″ is shown passing through the tubular sections 42″. A bolt 52 applies force to a tensioning piece 54 around which the tensioning member 40″ passes in a groove 56. The bolt 52 is threaded into a face piece 58 which is attached to the window sections 14″ and 12″. Tightening the bolt 52 applies force to the tension member 40″ and provides a taut, wrinkle-free film as described above. The base 58 is also provided with two extensions 62 and 64 rolled at the ends to provide a hinge and spring force to retaining loops 63 and 65. These loops 63 and 65 hold the folded portions 32″ and 34″ of the film 30″ flat against the frame sections 14″ and 12″, respectively. Along the bottom and sides of the window the film 30″ normally tends to lie flat and snug against the frame. This may, however, not be true in the case of the top of the frame where gravity may tend to cause to film to sag away at the edge. Therefore particularly at the top, and all around if the user prefers, retaining strip 35 may be used. As shown the retaining strip is fabricated of magnetic material and is attracted to the strip 37 which is affixed to the frame itself. This strip 37 may have a pressure sensitive adhesive backing, be stapled in place or affixed by any other conventional fastening means. Alternatively a retaining strip 35 may be fabricated form, for example, thin metal or wood, and held it in place with staples, screws or other fastening means.

Referring now to FIG. 4, an alternative corner fastening arrangement is shown. In this case the film material 100 is held in place by a corner fastener 102 which has been formed from sheet metal. The fastening 102 has wings with an angled edge 106 of approximately 30°. Since the film to be folded undergoes a 45° angle in two folds, the angle in theory might be 22½°. However, it is preferable to have the angle slightly larger, such as 30°, so that the film can be held taut without the necessity that it be pressed all of the way into the corner around the fastener 102. The portion of the fastener 102 having the angled edge 106 is offset from the plane of the pads 108 by which the fastener 102 is affixed to the frame, using for example screws 110. This offset provides room for the film 100 to be held in place by the M-shaped spring 104. The primary advantage of the structure of FIG. 4 as compared with that of FIG. 3 is that the corner fastener 102 may be fabricated much more cheaply as a sheet metal stamping. To hold the tensioning member 116 a cylindrical section 112, formed for example of plastic, has a groove 114 for the member 116. The retaining screw 118 applies the tensioning force to the tensioning member 116 through the element 112.

Since the M-spring 104 in FIG. 4 is partially obscured by the fastener 102 and the folded portion of the film material 100, it has been shown separately in plan view in FIG. 5 as element 104'.

FIG. 6 illustrates another tensioning member fastener suitable for applying tension and securing the two ends of a tensioning member 116'. This fastener has a screw 118' which would be in a position exactly similar to that of the screw 118 in FIG. 4. This screw applies force to the cylindrical section 120 which in turn through its curved under surface 124 applies force to the cylindrical secion 122. The ends of tensioning member 116 pass through holes 121 in the member 120, around the member 122 and back through the same hole. Thus when force is applied through tightening the screw 118, tension is applied to the tensioning member 116' and also the ends are held secure as the force pulls the member 112 snugly into the member 120. For clarity in the drawings the members 120 and 122 are shown somewhat separated.

Referring now to FIG. 7 an alternative film window material is shown. In this case the material is of double thickness and a channel for the tensioning member 116' has been formed between two spacers 126 and 128. These spacers may be cemented or heat sealed to the two films 101 and 103. A somewhat simpler and cheaper structure may be obtained by eliminating the spacers 126 and 128 and simply heat sealing or otherwise cementing together the two films 101 and 103 to form channels for the tensioning member 116'.

It will be apparent that applicant has provided a simple, readily installed framed aperture closure, the closure illustrated in the drawings being a transparent film suitable as a storm window. Alternatively it could be a screen or other temporary structure. Unlike prior devices, applicant's structure is not only easily installed and removed, but when installed provides a plane, wrinkle-free surface which does not produce distortion when one looks through the opening. When a film-type plastic is utilized, the film may be removed and rolled up for storage in a small place. It is not necessary to store large frames as is often done with storm windows.

It will be apparent that certain modifications may be made without departing from the scope of the present invention. For example, not only may different types of membranes or film be utilized, such as reflective films, but those skilled in the art may make variations in the tensioning apparatus. While a screw-type configuration is shown, it could be lever-actuated, or indeed if the utmost simplicity is desired, it can be a tension member passing around corner hooks and pulled taut and tied at one point. Similarly other clamping arrangements to hold the folded edge may be utilized. Indeed if the sealing action provided by the folded edge is not desired, the fold can be entirely eliminated. Although a double-hung window has been used in the example, any framed opening may be utilized, indeed it may be a circular opening with a series of circular arcs for the tensioning member around the perimeter. The angles of the fastening members would be adjusted to correspond with the surface or corner to which they are applied. Similarly, more than one arc per side may be desirable for long sides of an opening.

Having thus described my invention, I claim:

1. A protective flexible membrane structure installed in a framed opening with corners comprising a peripheral tension element, said tension element being attached to said membrane in curved relationship to said framed opening, said tensioning element lying in the plane of said membrane, the segments of said peripheral tension element at each side of said opening lying along segments of a circle, each of said segments lying alongside a side of said frame opening and in the plane of said membrane and corner tensioning means in the corners of said framed opening to apply force to said tension element whereby each of said segments of said peripheral tension element hold a side of said membrane in plane relationship within said opening and adjacent to the corresponding side of said framed opening.

2. Apparatus according to claim 1 wherein tubular sections affixed to said membrane along said circle segments hold said tension element in position.

3. Apparatus according to claim 1 incorporating means at the corners to hold said flexible membrane in overlapping sealing relationship to said framed opening.

4. Apparatus according to claim 3 incorporating retaining means to secure the edges of said flexible membrane to the sides of said framed opeing.

5. Apparatus according to claim 1 incorporating a second membrane to provide first and second membranes, portions of said first and second membranes being fastening together to form circle segment channels to hold said tension element in curved relationship to said framed opening.

* * * * *